United States Patent [19]

Ueno

[11] Patent Number: 4,737,746

[45] Date of Patent: Apr. 12, 1988

[54] DIELECTRIC FILTER

[75] Inventor: Moriaki Ueno, Soma, Japan

[73] Assignee: Alps Electric Co., Ltd., Japan

[21] Appl. No.: 920,840

[22] Filed: Oct. 17, 1986

[30] Foreign Application Priority Data

Oct. 18, 1985 [JP] Japan ..... 60-160175[U]

[51] Int. Cl.[4] ..... H01P 1/205

[52] U.S. Cl. ..... 333/202; 333/203; 333/222

[58] Field of Search ..... 333/202–212, 333/219–236, 245, 248, 185

[56] References Cited

U.S. PATENT DOCUMENTS

| | | | |
|---|---|---|---|
| 4,255,729 | 3/1981 | Fukasawa et al. | 333/202 |
| 4,342,972 | 8/1982 | Nishikawa et al. | 333/206 |
| 4,431,977 | 2/1984 | Sokola et al. | 333/222 X |
| 4,462,098 | 7/1984 | D'Avello et al. | 333/206 X |

FOREIGN PATENT DOCUMENTS

| | | | |
|---|---|---|---|
| 0065601 | 4/1985 | Japan | 333/202 |

*Primary Examiner*—Marvin L. Nussbaum
*Attorney, Agent, or Firm*—Guy W. Shoup

[57] ABSTRACT

A dielectric filter comprises holes provided on a dielectric block, an inner conductor formed inside each hole, an earth electrode formed outside the dielectric block, a short-circuit electrode to connect the inner conductor with the earth electrode, input and output terminals inserted in the holes, a projection of dielectric material provided on the dielectric filter, one electrode formed on one surface of the projection and connected to the earth electrode, and other electrode formed on other surface of the projection and connected to the inner conductor, thereby large capacitance is formed between both electrodes and the dielectric filter can be formed in small size.

1 Claim, 4 Drawing Sheets

DIELECTRIC FILTER

BACKGROUND OF THE INVENTION

1. Field of the Invention

The present invention relates to a dielectric filter of narrow band width used in communication apparatuses, for example, an automobile telephone.

2. Description of the Prior Art

In a high-frequency filter of narrow band width in mobile radio communication system such as an automobile telephone being a typical example, a dielectric filter satisfying requirements of small size, stoutness and high performance is generally used. Such dielectric filter is usually constituted in a filter of comb line type so as to reduce unit cost of the products.

A dielectric filter of comb line type in the prior art will be described referring to FIG. 5 and FIG. 6. Numeral 1 designates a dielectric block, numeral 2 a hole, numeral 3 an inner conductor, numeral 4 an earth electrode, numeral 5 a short-circuit electrode, numeral 6 an input or output terminal, and numeral 7 a terminal base to hold the terminal 6. The dielectric block 1 is made by sintering of dielectric powders, and a plurality of holes 2 are provided on the dielectric block 1, and the inner conductor 3 is formed inside each hole 2. The earth electrode 4 is formed on the lateral surface outside the dielectric block 1, and the short-circuit electrode 5 to connect the inner conductor 3 with the earth electrode 4 is formed on one end surface of the dielectric block 1. The terminal base 7 is inserted in the hole 2 provided on the dielectric block 1 so as to support the input or output terminal 6 and to form a capacitor (capacitors 13, 14 in FIG. 9) between the terminal 6 and the inner conductor 3, and the terminal 6 is inserted in the hole of the terminal base thereby the dielectric filter is constituted. In addition, dielectric substance of the inner conductor 3, the earth electrode 4 and the short-circuit electrode 5 is formed by applying silver paste and burning it or by means of electroless copper plating.

Operation principle of a comb line filter in such constitution is disclosed in references, for example, G. L. Matthaei, "Comb-Line Band-Pass Filters of Narrow or Moderate Band Width" The Microwave Journal vol. VI, No. 8 (August 1963). Consequently, the detailed description shall be omitted but portion relevant to the present invention be described here.

FIG. 9 shows an equivalent circuit of a comb-line filter constituted in two steps. Numerals 11, 12 designate distributed constant lines, numerals 13, 14 coupling capacitors for impedance conversion, numerals 15, 16 terminating capacitors, and numerals 17, 18 input and output terminals. The distributed constant lines 11, 12 are coupled electromagnetically with each other, and length of the distributed constant lines 11, 12 is less than the $\frac{1}{4}$ wavelength of the center frequency of the filter passing frequency band (the center frequency: arithmetic mean value of the upper limited frequency and the lower cut-off frequency of the passing signal). One end of the distributed constant lines 11, 12 is directly grounded, and other end thereof is grounded through the terminating capacitors 15, 16. The terminating capacitors 15, 16 are small capacitance produced when electric lines of force between the inner conductor 3 and the earth electrode 4 shown in FIGS. 5 and 6 slightly leak in the space at the open end of the dielectric filter (at side of the terminal 6), i.e., so-called fringing capacitance. If the capacitance value of the terminating capacitors 15, 16 is large, the distributed constant lines 11, 12 are shortened; if the capacitance value is small, the lines 11, 12 are lengthened. In any case, however, the length of the distributed constant lines 11, 12 is less than the $\frac{1}{4}$ wavelength.

In order to use such dielectric filter in the prior art, an earth plate 19 is required as shown in FIGS. 7 and 8. The earth plate 19 is closely contacted with the dielectric filter, i.e., with the earth electrode 4 and in electrically connected (conductive) state. The earth plate 19 is used to mount and hold the dielectric filter on a substrate or a chassis, for example, and a mounting member 20 is installed therefor.

Condition to secure the operation of the dielectric filter is in that the earth electrode 4 of the dielectric filter is securely grounded to the external circuit, for example, to the earth pattern of the substrate or the chassis. Consequently, the earth plate 19 is securely connected to the earth electrode 4 by means of a conductive adhesive or soldering, and at the same time grounded securely to the external circuit.

In the dielectric filter in the prior art as above described, since the terminating capacitors 15, 16 are constituted by the capacitance produced when the electric lines of force leak from the open end of the dielectric filter, the capacitance is small and the distributed constant lines 11, 12 constituted by the inner conductor 3 are lengthened and therefore the dielectric filter cannot be made compact. Moreover, since the earth plate 19 is used so as to ground the earth electrode 4 of the dielectric filter securely, work process such as soldering or applying of a conductive adhesive is required to connect the earth electrode 4 with the earth plate 19 securely. The connection by soldering or the like may become insecure and cause the incomplete grounding, thereby the dielectric filter is liable to the unstable operation.

SUMMARY OF THE INVENTION

In order to solve above-mentioned problems in the prior art, an object of the invention is to provide a dielectric filter wherein a projection of dielectric material is installed at open end of the dielectric filter and constitutes large capacitance, thereby an inner conductor to form distributed constant lines can be shortened and made compact.

A dielectric filter according to the invention to attain the above object, comprises holes provided on a dielectric block, an inner conductor formed inside each hole, an earth electrode formed outside the dielectric block, a short-circuit electrode to connect the inner conductor with the earth electrode, an input or output terminal installed in the hole so as to constitute a dielectric filter, a projection of dielectric material provided on the dielectric filter, an electrode formed on one surface of the projection and connected to the earth electrode, and other electrode connected to the inner conductor so as to constitute a capacitor between both electrodes.

The projection made of dielectric material is provided on the dielectric filter, the electrode connected to the earth electrode is formed on one surface of the projection, and other electrode connected to the inner conductor is formed so as to constitute the capacitor between both electrodes, thereby the capacitor other than fringing capacitance is connected between the earth electrode and the inner conductor, and the terminating capacitor can be constituted by parallel connection of the fringing capacitance and the capacitor and therefore the capacitance value of the terminating capacitor be enlarged, so that the inner conductor to constitute the distributed constant lines may be short and the dielectric filter can be made compact.

DESCRIPTION OF THE PREFERRED EMBODIMENTS

Figure 1:
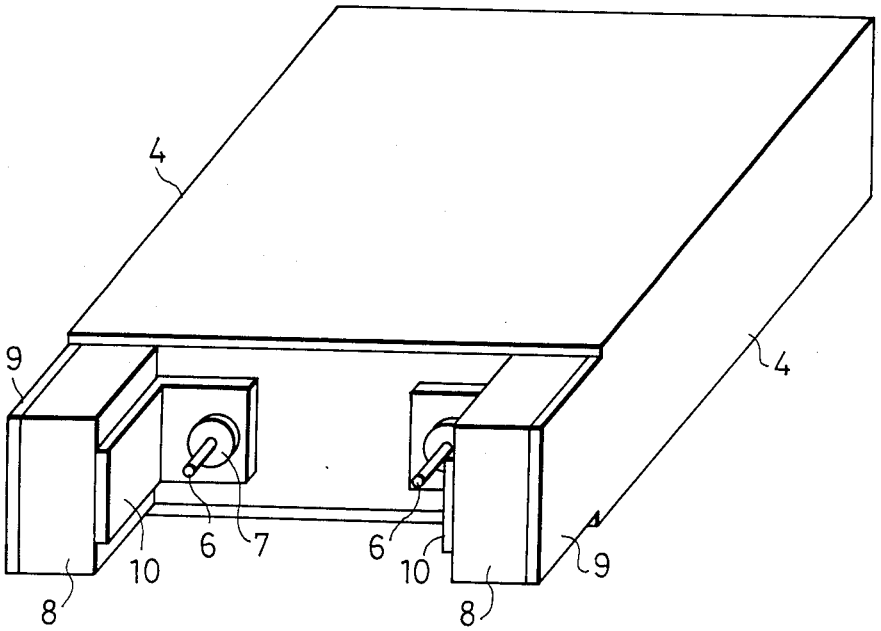
FIG. 1 is a perspective view of a dielectric filter as an embodiment of the invention.
Figure 2:
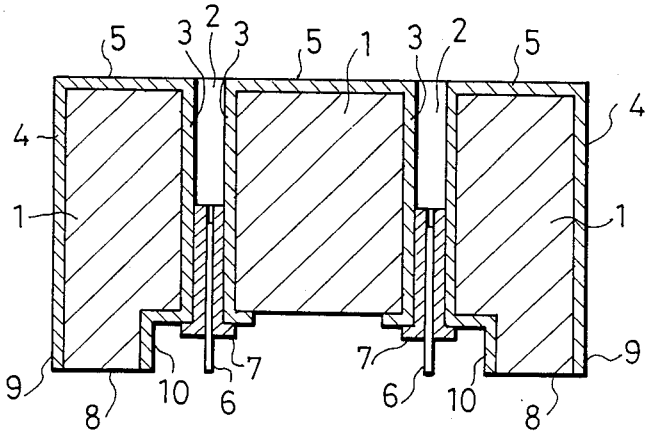
FIG. 2 is a sectional view of FIG. 1.

An embodiment of the present invention will now be described referring to FIG. 1 and FIG. 2. FIG. 1 is a perspective view of a dielectric filter as an embodiment of the invention, and FIG. 2 is a sectional view of FIG. 1. In FIGS. 1 and 2, like parts to those in FIGS. 5 through 8 are designated by the same reference numerals and the overlapped description shall be omitted.

In FIGS. 1 and 2, numeral 8 designates a projection, numeral 9 an electrode, and numeral 10 another electrode. When a dielectric block 1 is formed by dielectric powders, the projection 8 is also formed by the same material, and an earth electrode 4 is formed on outside lateral surface being one surface of the projection 8. The earth electrode 4 is extended and the electrode 9 is formed so that the electrode 4 and the electrode 9 are connected integrally. Other surface of the projection 8 corresponding to the electrode 9 has other electrode 10 formed by the inner conductor 3 extending onto the dielectric block 1, and both electrodes 9 and 10 constitute the capacitor. Capacitance of the capacitor is added to the terminating capacitors 15, 16. The electrode 9 and other electrode 10 are formed in similar manner to the inner conductor 3, the earth electrode 4 and the short-circuit electrode 5 such that electroless copper plating is performed or silver paste is applied and burned.

In this constitution, the projection 8 has the same function as that of the earth plate 19 and the mounting member 20. That is, the earth electrode 4 is securely grounded by connecting the electrode 9 of the projection 8 to the external circuit, and the projection 8 may be used as the mounting member when the dielectric filter is mounted on the substrate. Other electrode 10 may have considerably large dimension in width, length or the like, dielectric substance with large specific permittivity is interposed thereby the capacitor with large capacitance is obtained, and the distributed constant lines 11, 12 constituted by the inner conductor 3 may be shortened and size of the dielectric filter be reduced.

Figure 3:
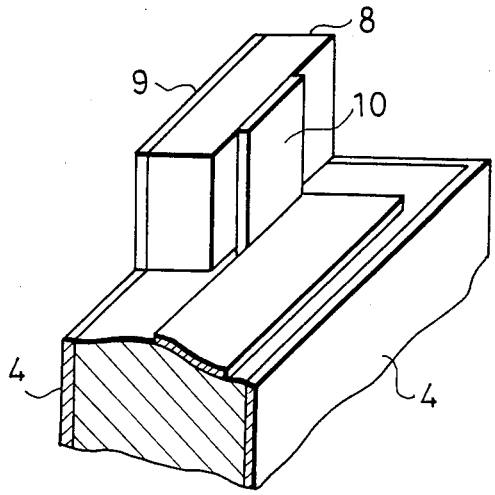
FIG. 3 is a perspective view of main part of a dielectric filter as another embodiment of the invention.

In another embodiment of the invention shown in FIG. 3, position of the projection 8 is transferred from that shown in FIGS. 1 and 2. Function of this embodiment is the same as that of FIGS. 1 and 2 and therefore the description shall be omitted.

Figure 4:
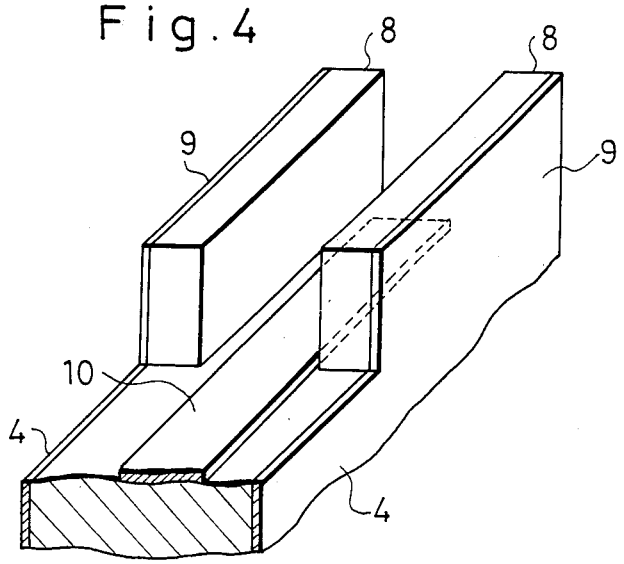
FIG. 4 is a perspective view of main part of a dielectric filter as still another embodiment of the invention.
Figure 5:
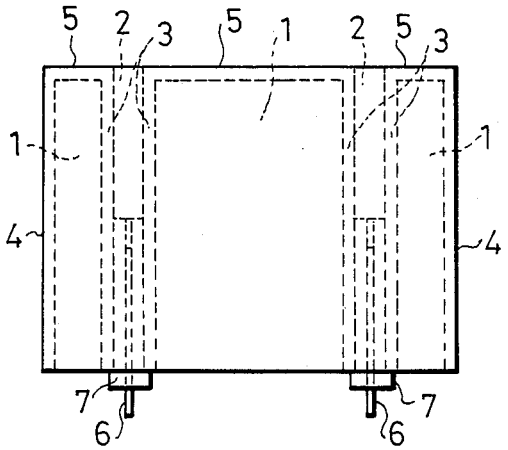
Fig. 5 PRIOR ART
FIG. 5 is a plan view of a dielectric filter in the prior art.
Figure 6:
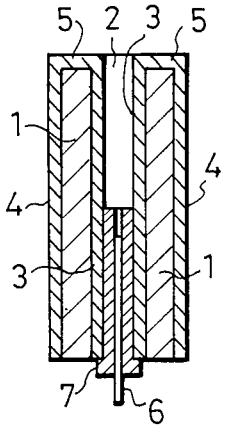
Fig. 6 PRIOR ART
FIG. 6 is a lateral sectional view of FIG. 5.
Figure 7:
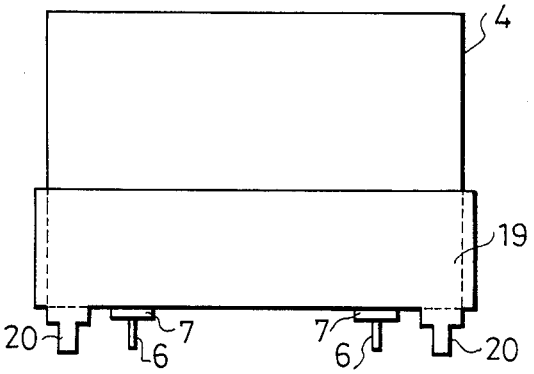
Fig. 7 PRIOR ART
FIG. 7 is a plan view of the dielectric filter of FIG. 5 illustrating installation state of an earth plate.
Figure 8:
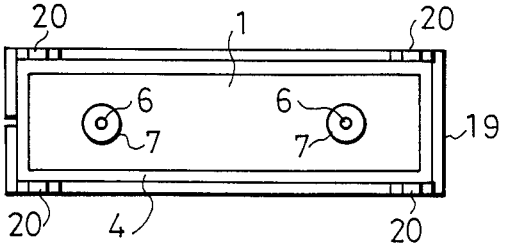
Fig. 8 PRIOR ART
FIG. 8 is a front view of FIG. 9.
Figure 9:
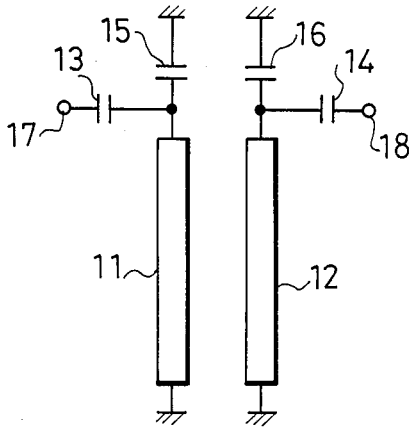
FIG. 9 is a circuit diagram illustrating an equivalent circuit of a dielectric filter.

In still another embodiment of the invention shown in FIG. 4, the projections 8 are opposed at both sides of the open end of the dielectric block 1. The earth electrode 4 and the electrode 9 are formed integrally on outside lateral surface of each projection 8, and other electrode 10 is formed on the open end surface between the projection 8 formed at both sides. Since the other electrode 10 is formed on the open end surface of the dielectric block 1, the capacitor of small capacitance is obtained in comparison to that in the embodiment of FIGS. 1 and 2. Of course, the capacitor of this embodiment in FIG. 4 has large cspacitance in comparison to the prior art.

According to the dielectric filter of the invention as above described, the projection is provided on the dielectric block, the electrode connected to the earth electrode is formed on the projection, and other electrode connected to the inner conductor is formed so that the capacitor is formed between both electrodes, thereby the terminating capacitance between the inner conductor and the earth electrode can be enlarged and length of the inner conductor to constitute the distributed constant lines may be shortened and the dielectric filter of small size is obtained. Furthermore, the projection is provided on the dielectric filter and mounted on the substrate or the like so as to hold the dielectric filter. Since the electrode connected to the earth electrode is formed on the projection, the earth electrode is securely grounded.

What is claimed is:

1. A dielectric filter adapted to be mounted on one side thereof to a substrate having an external circuit, comprising:

a dielectric block having a pair of dielectric projections formed integrally therewith extending in a longitudinal direction on said one side of the dielectric filter to be mounted on the substrate, said projections being spaced apart in a lateral direction so as to define a recess therebetween and each having an inner lateral surface facing into said recess and an outer lateral surface opposite therefrom;

a pair of spaced-apart holes provided through said dielectric block in the longitudinal direction extending to said recess on said one side;

an inner conductor formed in each hole;

input and output terminals each inserted in a respective one of said holes in capacitive relation to the respective inner conductors;

an earth electrode formed on an outer surface of said dielectric block a short-circuit electrode connecting each inner conductor with said earth electrode;

each of said pair of dielectric projections having one electrode formed on the outer lateral surface thereof connected to said earth electrode, and other electrode formed on the inner lateral surface thereof connected a respective inner conductor, so as to form an additional terminating capacitance between said one and the other electrodes spaced apart by the dielectric projection.

* * * * *